US007156074B2

(12) United States Patent
Hanasato

(10) Patent No.: US 7,156,074 B2
(45) Date of Patent: Jan. 2, 2007

(54) THROTTLE DEVICE

(75) Inventor: Maki Hanasato, Odawara (JP)

(73) Assignee: Mikuni Corporation, Tokyo (JP)

( * ) Notice: Subject to any disclaimer, the term of this patent is extended or adjusted under 35 U.S.C. 154(b) by 79 days.

(21) Appl. No.: 10/530,297

(22) PCT Filed: Oct. 10, 2003

(86) PCT No.: PCT/JP03/13034

§ 371 (c)(1),
(2), (4) Date: Apr. 5, 2005

(87) PCT Pub. No.: WO2004/033877

PCT Pub. Date: Apr. 22, 2004

(65) Prior Publication Data

US 2006/0157025 A1 Jul. 20, 2006

(30) Foreign Application Priority Data

Oct. 11, 2002 (JP) ..... 2002-298529

(51) Int. Cl.
*F02D 9/10* (2006.01)

(52) U.S. Cl. ..... 123/399; 123/337; 123/400

(58) Field of Classification Search ..... 123/337, 123/361, 397, 399, 400

See application file for complete search history.

(56) References Cited

U.S. PATENT DOCUMENTS

| | | | | |
|---|---|---|---|---|
| 5,033,433 | A * | 7/1991 | Churchill et al. | 123/361 |
| 5,036,816 | A * | 8/1991 | Mann | 123/361 |
| 6,152,108 | A * | 11/2000 | Adachi et al. | 123/399 |
| 6,662,779 | B1 * | 12/2003 | Kotouge | 123/336 |
| 2005/0087172 | A1 * | 4/2005 | Torii | 123/399 |

FOREIGN PATENT DOCUMENTS

| | | |
|---|---|---|
| JP | 63-80039 | 4/1988 |
| JP | 6-207535 | 7/1994 |
| JP | 8-218904 | 8/1996 |

* cited by examiner

*Primary Examiner*—Erick R Solis

(57) ABSTRACT

With the throttle apparatus of the present invention having a throttle valve 30 disposed at an intake passage, a throttle shaft 240 to open and close the throttle valve 30, a DC motor 51 to drive the throttle shaft 40, and so on, a second drive means 60 is disposed to exert return force to the throttle shaft 40 only for returning the throttle valve 30 to the rest position. With this structure, since return force is not exerted with a normal operation, load to the DC motor 51 is decreased, and an open-close operation can be preformed smoothly. By returning the throttle valve to the rest position utilizing other means than spring force, load to the motor is decreased, and open-close operation is smoothed.

5 Claims, 4 Drawing Sheets

THROTTLE DEVICE

TECHNICAL FIELD

The present invention relates to a throttle apparatus which has a throttle valve to open and close the intake passage of an engine. More particularly, it relates to a throttle apparatus which includes a mechanism to return the throttle valve to a specific rest position.

BACKGROUND ART

As a conventional throttle apparatus which is applied for an engine mounted on an automobile, a wire-cum-electronic controlled type and just an electronic controlled type are known.

For example, with the conventional wire-cum-electronic controlled type throttle apparatus for a six-cylinder V-type engine, the intake system has two surge tanks collecting three intake passages respectively which correspond to each cylinder and intake passages extending to the upstream side from each surge tank. By coupling two throttle valves disposed at each intake passage of the upstream side with one throttle shaft, and driving to open and close by a wire or a motor, the throttle valves are returned to a rest position at the closing side by a return spring disposed around the throttle shaft, for example, as disclosed in Japanese Patent Laid-open H6-207535.

Further, with a conventional electronic controlled type throttle apparatus, one throttle shaft being free to rotate links the two throttle valves which are respectively disposed at two intake passages which are formed in a throttle body. The open-close drive is performed by a motor which is disposed at one end side of the throttle shaft, and the throttle valves are returned to a rest position at the closing side by a return spring which is disposed at the other side of the throttle shaft, for example, as disclosed in Japanese Patent Laid-open H8-218904.

With the abovementioned conventional apparatuses, to return the throttle valves to a rest position at the closing side in a state of rest or emergency etc, a torsion type return spring with relatively large urging force is employed. In the normal open-close operation, the urging force of the return spring acts as a drive load to a motor etc. Therefore, the electric power consumption is increased, and the motor is upsized. Further, the apparatus is upsized as a whole.

The present invention was devised in view of the problems of the related art. The object of the present invention is to provide a throttle apparatus which performs a rapid return operation in the state of rest or emergency, while smoothly achieving an open-close operation by eliminating return force unneeded for a normal open-close operation which was needed conventionally.

DISCLOSURE OF THE INVENTION

A throttle apparatus of the present invention adopts a structure comprising a throttle valve which is disposed at an intake passage of an engine, a throttle shaft which supports the throttle valve to open and close, a first drive means which includes a motor for rotational driving of the throttle shaft, and a second drive means which exerts return force to the throttle shaft so as to return the throttle valve to a specific rest position.

With this structure, for a normal operation, when the throttle shaft is rotated by the first drive means, the throttle valve performs an open-close operation while rotating between the rest position at the closing side and the full open position. On the other hand, in the state of emergency etc. such as malfunction of the first drive means, the second drive means is activated; either by a driver's switch operation or automatically in the case of an electromagnetic type, and by a driver's hand operation in the case of a hand driven type. Then, the throttle shaft rotates, and returns the throttle valve to the rest position. In this manner, since the second drive means is not activated and does not exert return force during a normal operation, an open-close operation can be performed smoothly.

In the abovementioned structure, it is possible that the second drive means adopts a structure comprising a pulley which is fixed to the throttle shaft, a wire which is connected along the circumference direction of the pulley, and an electromagnetic solenoid which drives the wire.

With this structure, when the electromagnetic solenoid is activated and pulls the wire, the pulley rotates, and the throttle shaft, namely, the throttle valve rotates at the closing direction to return to the rest position. In this manner, since the second drive means is structured simply by adopting the electromagnetic type, reliability of the apparatus is secured and the apparatus is downsized.

In the abovementioned structure, it is possible to adopt a structure comprising an angle detect sensor which detects the angle position of the throttle valve, and a control means which controls the driving of at least the first drive means, and the control means drives the electromagnetic solenoid based on a detect signal from the angle detect sensor and a drive signal of the first drive means.

With this structure, in the case that the control means acknowledges an abnormal state based on the detecting signal from the angle detect sensor and the drive signal of the first drive means, the electromagnetic solenoid is automatically activated despite the driver's recognition and rapidly returns the throttle valve to the rest position.

Further, in the abovementioned structure, it is possible to adopt a structure that the second drive means comprises a pulley which is fixed to the throttle shaft, a wire which is connected along the circumference direction of the pulley, and a hand-driven operating lever which drives the wire.

With this structure, when the driver moves the operating lever and pulls the wire, the pulley rotates and the throttle shaft, namely, the throttle valve rotates at the closing side to return to the rest position. In this manner, since the second drive means is structured simply by adopting a hand driven type, reliability of the apparatus is secured and the apparatus is downsized.

In the abovementioned structure, the pulley can be disposed at the vicinity to which drive force of the first drive means is exerted.

With this structure, even if the return operation is performed while the drive force of the first drive means is exerted, torsion of the throttle shaft can be prevented because the urging force of the return operation is exerted to compete in the vicinity of the drive force. Particularly, in the case that the throttle shaft is supporting a plurality of throttle valves, synchronization deviation of each throttle valve can be prevented.

BRIEF DISCRIPTION OF THE DRAWINGS

BEST MODE FOR CARRYING OUT THE INVENTION

The embodiments of the present invention are explained in the following with reference to the attached drawings.

Figure 1:
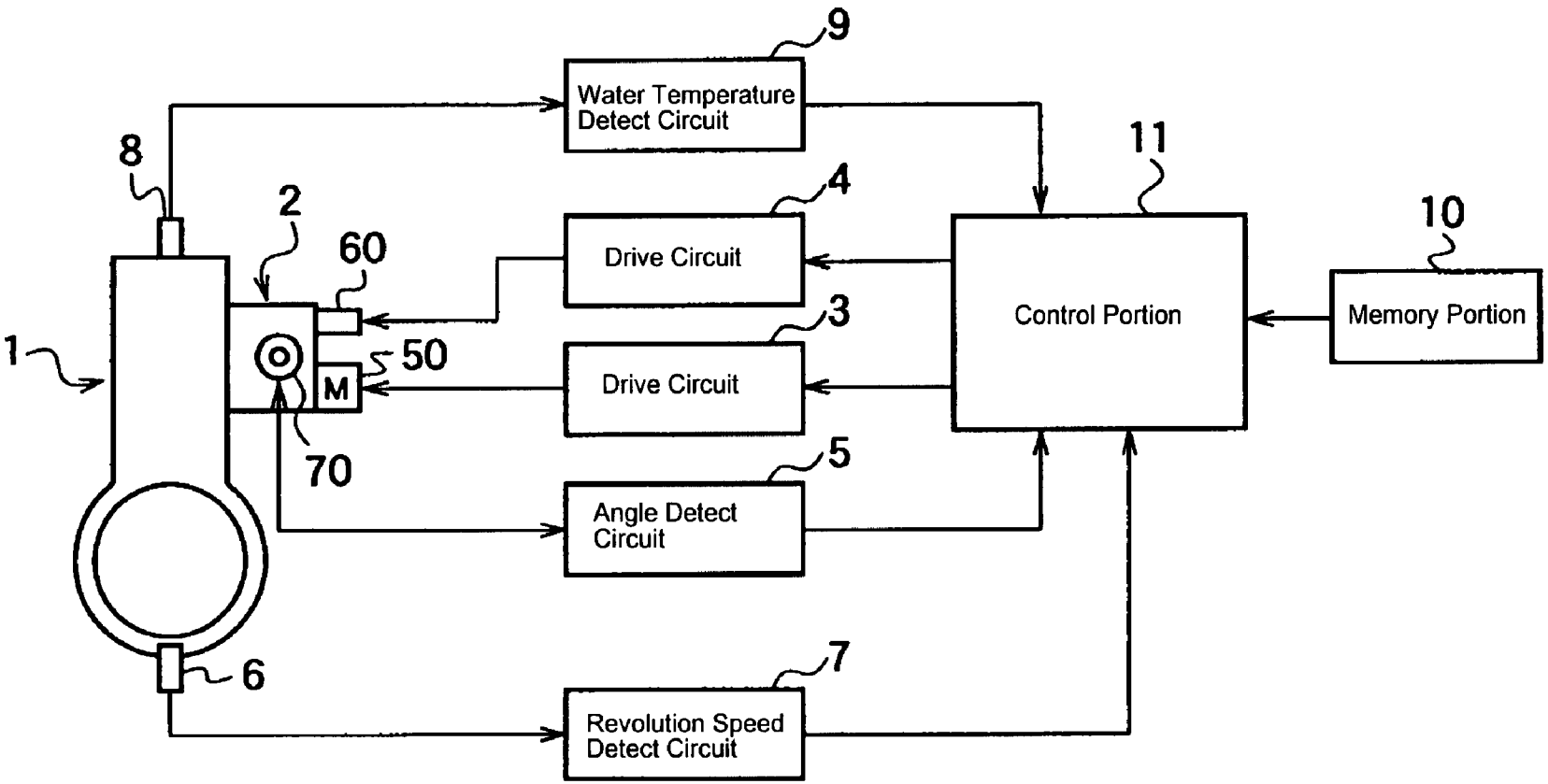
FIG. 1 is a block diagram showing the whole system which includes a throttle apparatus of the present invention.
Figure 2:
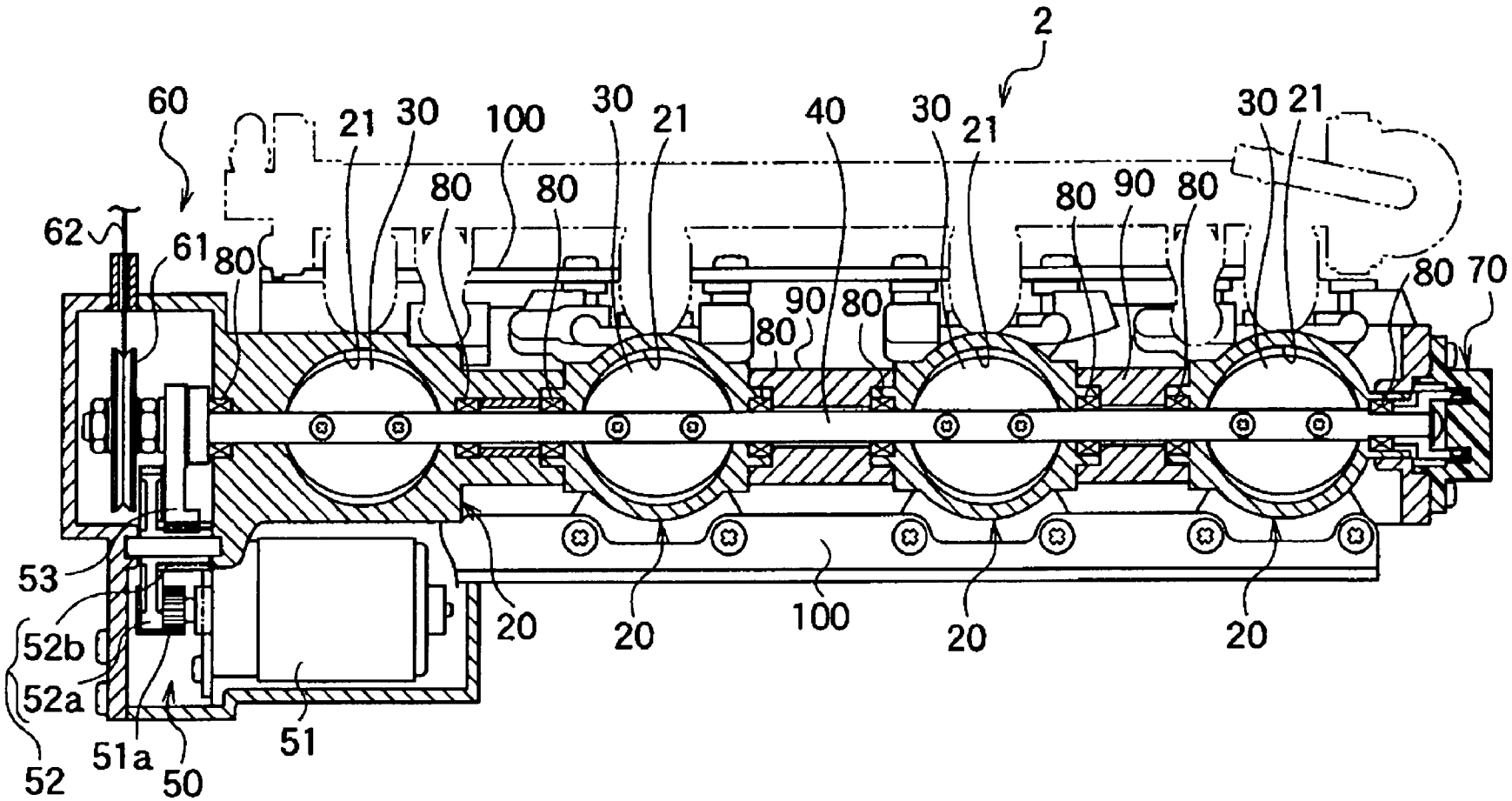
FIG. 2 is a sectional view showing an embodiment of a throttle apparatus of the present invention.
Figure 3:
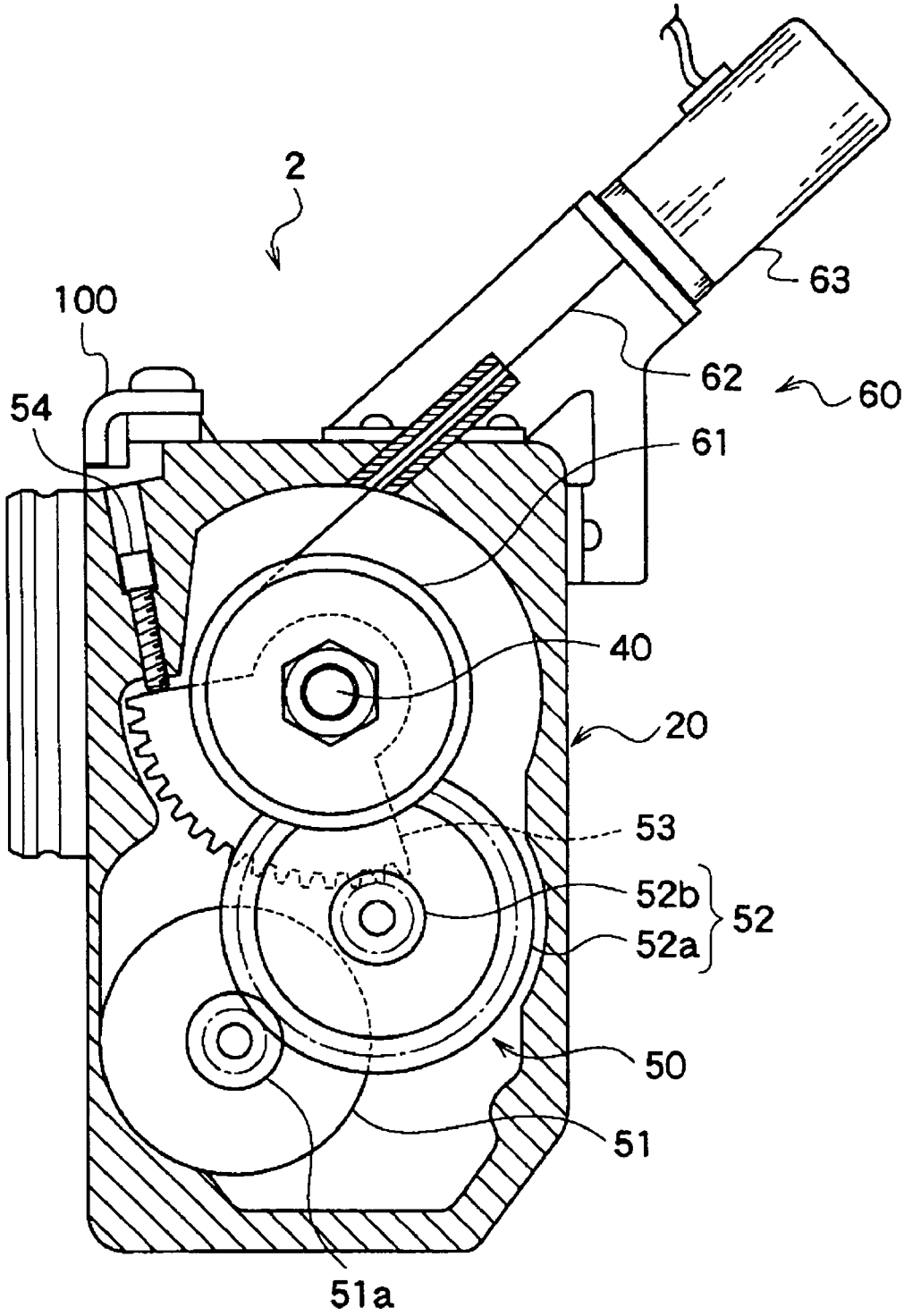
FIG. 3 is a side view showing a first drive means and an electromagnetically driven type second drive means of the apparatus shown in FIG. 2.

FIGS. 1 through 3 show an embodiment of a throttle apparatus of the present invention. FIG. 1 is a block diagram showing a control system. FIG. 2 is a sectional view of the throttle apparatus. FIG. 3 is a side view of an electromagnetic drive means etc.

As shown in FIG. 1, the control system comprises an engine 1, a four-barrel throttle apparatus 2 which is mounted on an intake system of the engine 1, a drive circuit 3 for driving a first drive means 50 which is disposed at the apparatus 2, a drive circuit 4 for driving a second drive means 60, an angle detect circuit 5 for processing signals from an angle detect sensor 70 which detects the angle position of a throttle valve 30 of the apparatus 2, a revolution sensor 6 and a revolution speed detect circuit 7 for detecting revolution speed of the engine 1, a water temperature sensor 8 and a water temperature detect circuit 9 of the engine 1, a memory portion 10 in which various control information and drive maps etc. are previously stored, a control portion 11 as a control means to control the whole system, and so on.

The apparatus 2 is a four-barrel throttle apparatus which is applied for an in-line four cylinder engine mounted on a motorcycle. As shown in FIG. 2 and FIG. 3, the apparatus 2 comprises four throttle bodies 20 which form the intake passages 21, four throttle valves 30 which are disposed at the intake passages 21, a throttle shaft 40 which rotatably supports the four throttle valves 30 to be opened and closed simultaneously, a first drive means 50 for rotational driving of the throttle shaft 40, a second drive means 60 for applying return force to return the throttle valves 30 to a specific rest position, an angle detect sensor 70 for detecting the rotation angle of the throttle shaft 40, and so on.

In addition, the apparatus 2 further comprises bearings 80 to rotatably support the throttle shaft 40, spacers 90 to couple throttle bodies 20, connect frames 100 to connect the four throttle bodies 20, and so on.

As shown in FIG. 2 and FIG. 3, the first drive means 50 is formed by a DC motor 51 which has a pinion 51*a*, a gear 52 which integrally has a large gear 52*a* and a small gear 52*b* which intermeshes with the pinion 51*a*, a gear 53 fixed to one end portion of the throttle shaft 40 while being intermeshed with the gear 52 (the small gear 52*b*), an adjust screw 54 which restricts the rotating end (namely, the angle position) of the gear 53, and so on.

When the DC motor 51 rotates, its rotational drive force is transmitted to the throttle shaft 40 via the pinion 51*a* and the gear train (the gear 52, the gear 53). Then, the throttle shaft 40 rotates within a specific rotating angle range, and the throttle valves 30 perform an open-close operation while rotating within the range between a specific rest position and the full open position.

As shown in FIG. 2 and FIG. 3, the second drive means 60 is formed by a pulley 61 which is fixed to the throttle shaft 40 at the outside of the gear 53, a wire 62 connected along the circumference direction while being inserted to a slot of the pulley 61, a pull-type electromagnetic solenoid 63 for pull driving of the wire 62, and so on.

Then, in the case of emergency, when the electromagnetic solenoid 63 is driven and the throttle valves 30 are at the full open position, the wire 62 retracts and the pulley 61 rotates clockwise in FIG. 3. When the gear 53 contacts to the adjust screw 54 and stops, the throttle valves 30 return to the rest position.

Namely, in specific cases such as emergency etc, the second drive means 60 exerts return force to the throttle shaft 40 only when returning the throttle valves 30 to the rest position at the closing side. In a normal open-close operation other than mentioned above, the second drive means 60 is not driven and does not exert return force.

Here, during the open-close operation of the throttle valves 30 while the gear 53 is driven, the wire 62 generates no tension and causes no load. Namely, the wire 62 is formed so as to be retracted and generate tension only when the solenoid 63 is operated. For example, when the pulley 61 positions at the counterclockwise rotation end in FIG. 3, tension is not generated even when the wire 62 is extended. On the other hand, a mechanism is adopted which allows or absorbs looseness of the wire 62 when the pulley 61 positions at the clockwise rotation end.

In this manner, since the second drive means 60 does not exert return force during a normal open-close operation, load affected to the first drive means 50 is decreased. Therefore, electric power consumption of the DC motor 51 is decreased. Further, since the structure of the second drive means 60 is simple by comprising the pulley 61, the wire 62, the electromagnetic solenoid 63 and so on, reliability of the apparatus is secured and the apparatus is downsized.

Further, as shown in FIG. 2, the pulley 62 is disposed in the vicinity of the gear 53 which transmit drive force. Therefore, even in the state that the DC motor 51 exerts drive force and the electromagnetic solenoid 63 is activated to generate return force against the drive force, torsion of the throttle shaft 40 can be prevented. With this structure, synchronization deviation (namely, respective phase deviation) of a plurality of the throttle valves 30 which are supported by the throttle shaft 40 can be prevented.

Next, the entire operation of the abovementioned throttle apparatus is explained.

When the DC motor 51 rotates in one direction in accordance with a signal from the control portion 11, rotational drive force is transmitted to the throttle shaft 40 via the gear train (namely, the pinion 51*a*, the gear 52, and the gear 53). Then, the throttle shaft 40 starts to rotate in one direction, and the throttle valves 30 rotate from the rest position to the position at which the intake passages 21 are fully opened.

On the contrary, when the DC motor 51 rotates in the other direction in accordance with a signal from the control portion 11, the throttle shaft 40 rotates in the other direction following the reverse course. Then, the throttle valves 30 rotate from the full open position to the rest position at which the intake passages 21 are closed.

At a normal drive state, the rotation of the DC motor 51 is appropriately controlled in accordance with the control mode. Then, the throttle valves 30 are driven to open and close to be at an appropriate opening. Further, to stop the engine 1, the DC motor 51 stops when the throttle valves 30 return to the rest position.

In this normal operation, the control portion 11 does not send a drive signal to the second drive means 60. Therefore, return force is not generated, and the throttle valves 30 smoothly perform an open-close operation.

On the other hand, in the case that the apparatus is judged to be at an abnormal state based on a detecting signal from the angle detect sensor 70 and a drive signal of the first drive means 50, for example, in the case that the throttle valves 30 are not controlled to be at a desired opening, the control portion 11 sends a drive signal to the second drive means 60 via the drive circuit 4.

In this manner, the electromagnetic solenoid 63 operates, and retracts the wire 62. Then, the pulley 61 rotates the throttle shaft 40 and returns the throttle valves 30 to the rest position at the closing side. As mentioned above, since the return operation is automatically performed when the control portion 11 acknowledges an abnormal state despite the driver's recognition, a dangerous state can be avoided. In this case, the on-off control or the duty control etc. can be appropriately selected as the drive condition of the electromagnetic solenoid 63. Therefore, time which is needed for the return operation can be freely set, and appropriate conditions can be provided in accordance with the vehicle to which the system is mounted.

Figure 4:
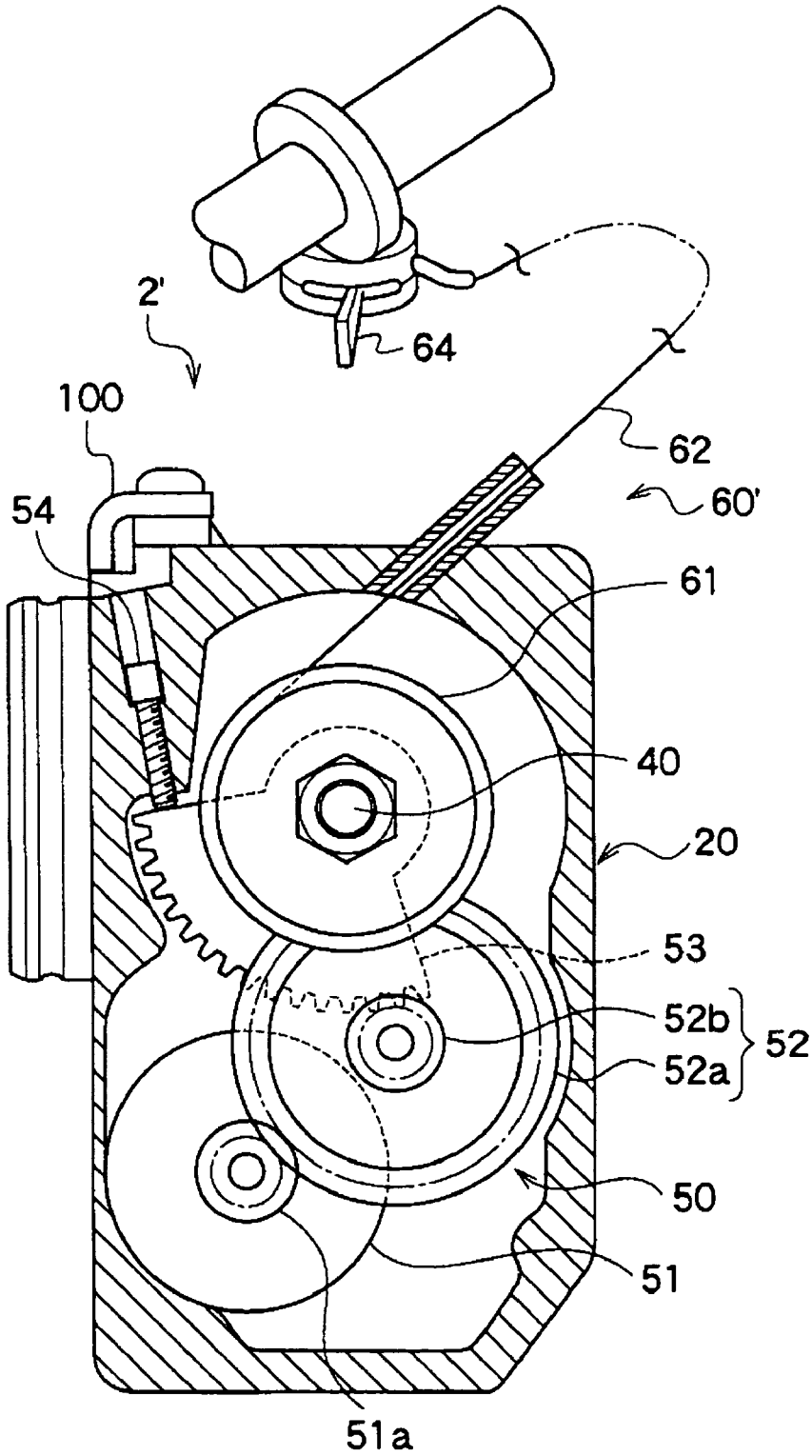
FIG. 4 is a side view showing a first drive means and a hand driven type second drive means of another embodiment of a throttle apparatus of the present invention.

FIG. 4 shows another embodiment of a throttle apparatus of the present invention. The same numeral is given to the same structure of the abovementioned embodiment to omit explanation.

As shown in FIG. 4, in the apparatus 2', a hand driven type second drive means 60' is adopted instead of the abovementioned electromagnetically driven second drive means 60.

Namely, as shown in FIG. 4, the second drive means 60' is formed by the pulley 61 and the wire 62 which are similar as mentioned above, an operating lever 64 to pull the wire by a hand operation, and so on.

Then, when the operating lever 64 is driven in the case of emergency etc. and the throttle valves 30 are at the full open position, the wire 62 is pulled and the pulley 61 rotates clockwise in FIG. 4. When the gear 53 contacts to the adjust screw 54 and stops, the throttle valves 30 return to the rest position.

Namely, in specific cases such as emergency etc, the second drive means 60' exerts return force to the throttle shaft 40 only when returning the throttle valves 30 to the rest position at the closing side. In a normal open-close operation other than the abovementioned embodiment, unless the driver operates, the return force is not exerted.

Here, during the open-close operation of the throttle valves 30 while the gear 53 is driven, the wire 62 generates no tension and causes no load. Namely, the wire 62 is formed so as to be pulled and generate tension only when the operating lever 64 is operated. For example, as mentioned above, when the pulley 61 positions at the counterclockwise rotation end in FIG. 4, tension is not generated even when the wire 62 is extended. On the other hand, a mechanism is adopted which allows or absorbs looseness of the wire 62 when the pulley 61 positions at the clockwise rotation end.

In this manner, since the second drive means 60' does not exert return force during a normal open-close operation, load affected to the first drive means 50 is decreased. Therefore, electric power consumption of the DC motor 51 is decreased. Further, since the structure of the second drive means 60' is simple by comprising the pulley 61, the wire 62, the operating lever 64 and so on, reliability of the apparatus is secured and the apparatus is downsized.

Next, the entire operation of the abovementioned throttle apparatus is explained.

When the DC motor 51 rotates in one direction in accordance with a signal from the control portion 11, rotational drive force is transmitted to the throttle shaft 40 via the gear train (namely, the pinion 51*a*, the gear 52, and the gear 53). Then, the throttle shaft 40 starts to rotate in one direction, and the throttle valves 30 rotate from the rest position to the position at which the intake passages 21 are fully opened.

On the contrary, when the DC motor 51 rotates in the other direction in accordance with a signal from the control portion 11, the throttle shaft 40 rotates in the other direction following the reverse course. Then, the throttle valves 30 rotate from the full open position to the rest position at which the intake passages 21 are closed.

At a normal drive state, the rotation of the DC motor 51 is appropriately controlled in accordance with a control mode. Then, the throttle valves 30 are driven to open and close to be at an appropriate opening. Further, to stop the engine 1, the DC motor 51 stops when the throttle valves 30 return to the rest position.

In this normal operation, unless the driver operates the second drive means 60' by mistake, return force is not generated. Therefore, the throttle valves 30 smoothly perform an open-close operation.

On the other hand, in the case that the driver acknowledges an abnormal condition in the apparatus 2', for example, in the case that the revolution speed of the engine 1 does not decrease despite the throttle closing operation, the driver operates the operating lever 64.

In this manner, the wire 62 is pulled. Then, the pulley 61 rotates the throttle shaft 40, and returns the throttle valves 30 to the rest position at the closing side. As mentioned above, by performing the return operation when the driver acknowledges an abnormal condition, a dangerous state can be avoided. In this case, by appropriately adjusting the torsion of the wire 62, time which is needed for the return operation can be freely set, and appropriate conditions can be provided in accordance with the vehicle to which the system is mounted.

In the abovementioned embodiment, a four-barrel throttle apparatus is shown in which four throttle valves 30 are integrally supported by a throttle shaft 40. However, not limited to this, the structure of the present invention can be adopted to a throttle apparatus having a single throttle valve, or a multiple throttle apparatus having three throttle valves, five throttle valves or more.

Further, in the abovementioned embodiment, an electromagnetic solenoid 63 is adopted as the second drive means 60. However, not limited to this, other drive sources can be also adopted.

Furthermore, in the abovementioned embodiment, conventional torsion return spring is not adopted. However, it is also possible to add a torsion spring with slight urging force to eliminate backlash etc. at the gear train of the first drive means 50.

INDUSTRIAL APPLICABILITY

As mentioned above, with the throttle apparatus of the present invention having a throttle shaft to open and close a throttle valve which is disposed at an intake passage of an engine, and a first drive means which includes a motor for rotational driving of the throttle shaft, an electromagnetically driven type or hand driven type second drive means is adopted to exert return force to the throttle shaft when returning the throttle valve to a specific rest position. Since return force is not exerted with a normal operation, an open-close operation can be performed smoothly. Particularly, since load affected to the first drive means is decreased, electric power consumption is decreased. Further, downsizing of the motor and downsizing of the apparatus can be achieved.

The invention claimed is:

1. A throttle apparatus, comprising:

a throttle valve which is disposed at an intake passage of an engine;

a throttle shaft which supports said throttle valve to open and close;

a first drive means which includes a motor for rotational driving of said throttle shaft; and a second drive means which exerts return force to said throttle shaft so as to return said throttle valve to a specific rest position.

2. The throttle apparatus according to claim 1, wherein said second drive means comprises a pulley which is fixed to said throttle shaft, a wire which is connected along the circumference direction of said pulley, and an electromagnetic solenoid which drives said wire.

3. The throttle apparatus according to claim 2, further comprising an angle detect sensor which detects angle position of said throttle valve, and a control means which controls the driving of at least said first drive means;

wherein said control means drives said electromagnetic solenoid based on a detect signal from said angle detect sensor and a drive signal of said first drive means.

4. The throttle apparatus according to claim 1, wherein said second drive means comprises a pulley which is fixed to said throttle shaft, a wire which is connected along the circumference direction of said pulley, and a hand-driven operating lever which drives said wire.

5. The throttle apparatus according to any one of claims 2 through 4, wherein said pulley is disposed at the vicinity to which drive force of said first drive means is exerted.

* * * * *